US009180504B2

(12) United States Patent
Baumgärtel et al.

(10) Patent No.: US 9,180,504 B2
(45) Date of Patent: Nov. 10, 2015

(54) DEVICE FOR INFLUENCING THE TEMPERATURE DISTRIBUTION OVER A WIDTH

(75) Inventors: Uwe Baumgärtel, Hilchenbach (DE); Jürgen Seidel, Kreutzal (DE)

(73) Assignee: SMS group GMBH, Düsseldorf (DE)

( * ) Notice: Subject to any disclaimer, the term of this patent is extended or adjusted under 35 U.S.C. 154(b) by 487 days.

(21) Appl. No.: 12/451,490

(22) PCT Filed: Apr. 3, 2008

(86) PCT No.: PCT/EP2008/002643

§ 371 (c)(1),
(2), (4) Date: Nov. 12, 2009

(87) PCT Pub. No.: WO2008/145222

PCT Pub. Date: Dec. 4, 2008

(65) Prior Publication Data

US 2010/0132426 A1 Jun. 3, 2010

(30) Foreign Application Priority Data

May 30, 2007 (DE) ..... 10 2007 025 287
Jun. 8, 2007 (DE) ..... 10 2007 026 578
Nov. 9, 2007 (DE) ..... 10 2007 053 523

(51) Int. Cl.
*B21B 37/44* (2006.01)
*B21B 45/02* (2006.01)
(Continued)

(52) U.S. Cl.
CPC ..... *B21B 37/44* (2013.01); *B21B 37/74* (2013.01); *B21B 45/0218* (2013.01);
(Continued)

(58) Field of Classification Search
CPC .... B21B 37/44; B21B 37/74; B21B 45/0218; B21B 45/0233
USPC ..... 72/201, 342.2, 8.1, 8.3, 8.5, 8.9, 9.1, 72/11.3, 11.7, 11.6, 236, 202
See application file for complete search history.

(56) References Cited

U.S. PATENT DOCUMENTS 2,271,372 A * 1/1942 Herman et al. ..... 148/604
4,031,946 A * 6/1977 Marti et al. ..... 164/486
(Continued)

FOREIGN PATENT DOCUMENTS

CA 2116230 1/1994
DE 35 16 779 11/1985
(Continued)

*Primary Examiner* — Shelley Self
*Assistant Examiner* — Mohammad I Yusuf
(74) *Attorney, Agent, or Firm* — Lucas & Mercanti, LLP; Klaus P. Stoffel

(57) ABSTRACT

The invention pertains to a device for influencing the temperature distribution over the width of a slab or a strip, particularly in hot strip rolling mill, wherein at least one cooling device is provided that features nozzles for applying a cooling medium, wherein the nozzles are arranged and/or actuated in such a way that the cooling medium is applied, in particular, at positions at which an elevated temperature is determined. The invention furthermore pertains to a device for influencing the state of the surface evenness of the strip by means of strip cooling, wherein the cooling device is controlled in dependence on the state of surface evenness of the strip in such a way that the surface unevenness is reduced or eliminated. In addition, this invention makes it possible to purposefully influence the strip contour, wherein the strip or the slab is cooled widthwise in such a way that the strip contour approximates a desired target contour more closely.

15 Claims, 12 Drawing Sheets

(51) Int. Cl.

| | |
|---|---|
| ***B21B 37/74*** | (2006.01) |
| *B21B 38/00* | (2006.01) |
| *B21B 38/02* | (2006.01) |

(52) U.S. Cl.

CPC ..... *B21B 45/0233* (2013.01); *B21B 38/006* (2013.01); *B21B 38/02* (2013.01); *B21B 2261/21* (2013.01); *B21B 2263/04* (2013.01)

(56) References Cited

U.S. PATENT DOCUMENTS

| | | | | | |
|---|---|---|---|---|---|
| 4,256,168 | A | * | 3/1981 | Hein et al. | 72/201 |
| 4,596,615 | A | * | 6/1986 | Matsuzaki et al. | 72/201 |
| 4,658,614 | A | * | 4/1987 | Wakamiya | 72/8.5 |
| 4,706,480 | A | * | 11/1987 | Svatos | 72/11.4 |
| 4,785,646 | A | * | 11/1988 | Uekaji et al. | 72/8.5 |
| 5,634,360 | A | * | 6/1997 | Tazoe et al. | 72/250 |
| 5,799,523 | A | * | 9/1998 | Seidel et al. | 72/201 |
| 6,062,056 | A | * | 5/2000 | Groch | 72/201 |
| 6,092,586 | A | | 7/2000 | Schoenbeck | |
| 7,963,136 | B2 | | 6/2011 | Flick et al. | |
| 8,387,433 | B2 | * | 3/2013 | Berghs et al. | 72/201 |
| 2011/0036555 | A1 | * | 2/2011 | Plicht et al. | 72/201 |

FOREIGN PATENT DOCUMENTS

| | | | |
|---|---|---|---|
| EP | 0 136 921 | | 4/1985 |
| JP | 60 235015 | | 11/1985 |
| JP | 63-115603 | * | 5/1988 |
| RU | 2120482 | | 10/1998 |
| RU | 2163934 | | 3/2001 |
| RU | 2247617 | | 3/2005 |
| SU | 778845 | | 11/1980 |
| SU | 863039 | | 9/1981 |
| SU | 904820 | | 2/1982 |
| SU | 1031548 | | 7/1983 |
| SU | 1371730 | | 2/1988 |
| WO | 2006042606 | | 4/2006 |

* cited by examiner

DEVICE FOR INFLUENCING THE TEMPERATURE DISTRIBUTION OVER A WIDTH

TECHNICAL FIELD

The invention pertains to a device according to Claim 1 for influencing the widthwise temperature distribution, especially of a strip, particularly in a hot strip rolling mill.

STATE OF THE ART

In the manufacture of strips such as, in particular, in hot-rolling mills, a strip is transported from the furnace to the coiler and processed during this transport. In this case, the temperature of the strip and its temperature distribution, for example, referred to the strip width play a decisive role in the processing of the strip and the strip quality resulting thereof.

If a high productivity of a system or hot strip rolling mill should be realized, the furnace such as, for example, a walking beam furnace frequently represents the production bottleneck. Although this leads to the slabs being heated to a sufficiently hot temperature, they have not assumed a uniform temperature distribution because they did not remain in the furnace for a sufficiently long period of time.

This can result in non-uniform temperature distributions referred to the width of the slabs. This in turn can result in conventional slabs having a non-uniform temperature distribution when they exit the furnace. In this case, the surface and the slab edge are typically warmer than the remaining slab. During a subsequent rolling process in a blooming train, the temperature profile is changed and the absolute strip edge is additionally cooled due to lateral heat radiation and the passage through the descaling sprayer and the edger, wherein this leads to such a temperature distribution being adjusted upstream of a final deformation phase that the average temperature referred to the thickness decreases on the edge and toward the center while a local temperature maximum occurs in the vicinity of the edge. In this case, the warmer regions may lie between approximately 80 and 150 mm from the edge and therefore have altogether negative effects on the strip contour and the surface evenness of the strip. During the ensuing rolling process, such a non-uniform temperature distribution results in a different flattening being produced in the roll gap on the different finishing stands, as well as in different working roll wear and a thermal crown being adjusted over the band width. This leads to profile anomalies that interfere with the additional processing of the strip and result in strips with little dimensional accuracy, wherein the latter is particularly undesirable with respect to the quality. This also cannot be prevented with additional mechanical profile correcting elements because the effects are highly local.

In addition to the geometric disadvantages, the temperature differences may also lead to different structures or mechanical strip properties over the strip width.

In addition to the non-uniform heating of conventional slabs in the furnace, these slabs can also be observed with non-uniform temperatures downstream of a thin slab mill. If the temperature differences are not completely equalized in the downstream furnace, the above-described disadvantages such as profile anomalies, surface unevenness and different mechanical strip properties over the strip width may also occur in this case.

DISCLOSURE OF THE INVENTION, PROBLEM DEFINITION, SOLUTION, ADVANTAGES

The invention is based on the objective of developing a device that allows an improved processing, in particular, of strips in hot strip rolling mills and results in a higher product quality.

According to the invention, the objective with respect to the device is attained with the characteristics of Claim 1. The inventive device serves for influencing the temperature distribution over the width of a slab or a strip, in particular, in a single-stand or a multiple-stand hot-rolling mill, wherein at least one cooling device is provided that features nozzles for applying a cooling medium on the slab or the strip, and wherein the nozzles are distributed over the width and/or controlled in such a way that a cooling medium is applied, in particular, at positions at which an elevated temperature is determined.

According to another embodiment of the invention, the surface evenness of the strip and the strip contour are influenced by partially cooling the strip. The strip essentially is cooled at the locations at which waves are detected in order to purposefully change the material strength. Analogously, strip locations are cooled in order to purposefully realize contour changes of the strip at these locations. The contour is usually influenced on thicker strips and the surface evenness is influenced on smaller thicknesses. The active principle is identical.

In order to define the cooling medium distribution, it is advantageous to divide the width of the strip into cooling zones, wherein a nozzle of the cooling device can be provided or arranged for at least one zone, preferably for all zones.

It is also practical if the at least one nozzle or several nozzles is or are adjustable with respect to their position referred to the width of the strip.

In one embodiment, it is furthermore practical to arrange the nozzles in pairs, preferably in a paired fashion and symmetrical referred to the center of the strip.

In order to eliminate the need for a separate width adjusting mechanism, the width adjustment of the nozzles referred to their nozzle positions may be realized by mounting the nozzles on the lateral slab or strip guides.

In order to allow a flexible width adjustment of the nozzle positions, a separate adjusting device can also be independently used for the right and the left strip half.

It is furthermore advantageous if the nozzles are arranged adjacent to one another, wherein one nozzle is assigned to each cooling zone.

In this case, it is practical to arrange nozzles underneath and/or above the strip.

A purposeful activation of the nozzles is promoted by means of at least one measuring sensor that determines the—widthwise—temperature distribution of the slab or the strip.

In another embodiment, it is practical to also provide a control unit that processes relevant input variables and determines and controls the cooling medium quantity to be applied in the respective cooling zone and/or cooling position.

Advantageous additional developments are described in the dependent claims.

BRIEF DESCRIPTION OF THE FIGURES

One embodiment of the invention is described in greater detail below with reference to the figures. The figures show.

PREFERRED EMBODIMENT OF THE INVENTION

Figure 1:
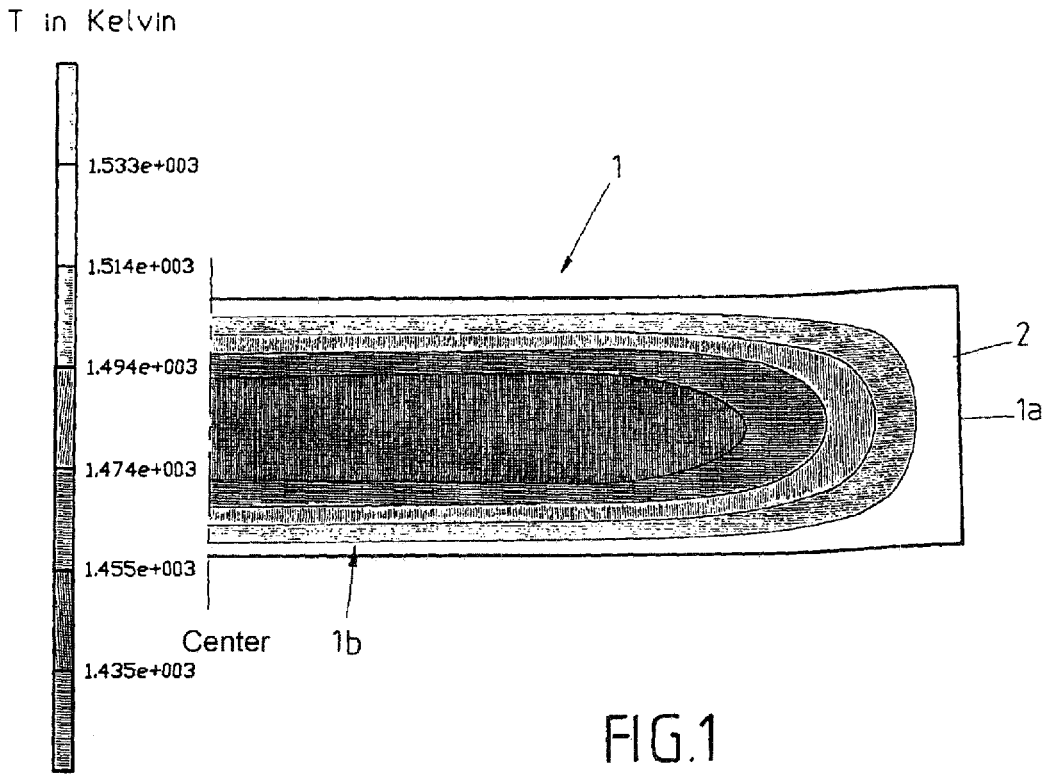
FIG.1 Prior Art
FIG. 1, an illustration of a temperature distribution of a slab with the aid of off-colors.

FIG. 1 shows an illustration of one half of a slab 1, wherein a temperature distribution is visualized with the aid of off-colors, and wherein the temperature is the hotter the brighter the color or the shade of gray, respectively. The slab 1 already is non-uniformly heated when it exits a conventional furnace of a hot strip rolling mill, wherein this may also be caused by an excessively short furnace residence time, e.g., due to a high rate of furnace utilization. On the surface and on the edge 1*a* or on the slab edge 2, respectively, the slab 1 is hotter than, for example, in the core 1*b* that is illustrated with a dark color. The slab 1 therefore is not optimally soaked.

Figure 2:
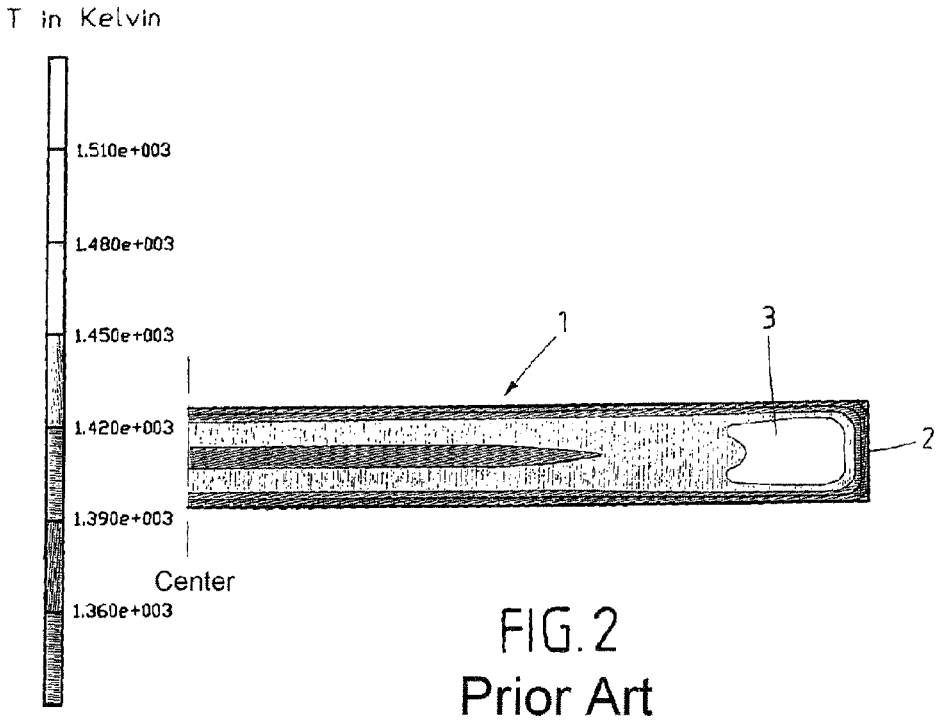
FIG. 2 Prior Art
FIG. 2, an illustration of a temperature distribution of a slab after the rolling process with the aid of off-colors.
Figure 3:
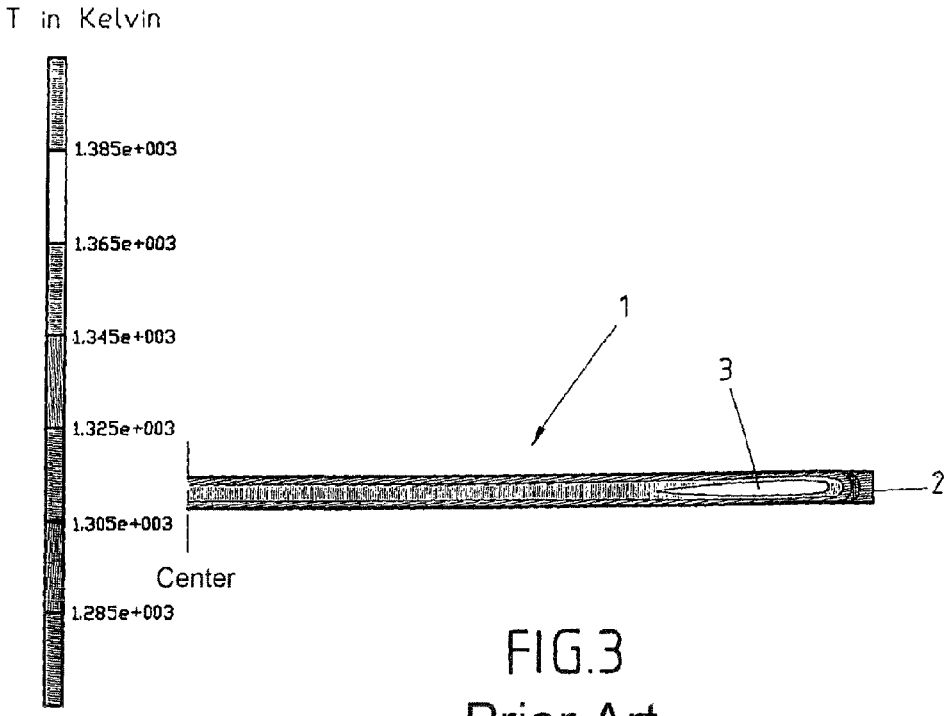
FIG. 3 Prior Art
FIG. 3, an illustration of a temperature distribution of a slab after the rolling process with the aid of off-colors.

During a rolling process on a blooming train, the temperature profile of the slab 1 changes such that the rolled slabs 1 have a temperature profile, for example, that corresponds to that shown in FIGS. 2 and 3. The strip edge 2 is additionally cooled due to the rolling process and a hot zone 3 is formed that is situated adjacent to the strip edge 2. In FIGS. 2 and 3, the shades of gray indicate the temperature distribution, wherein the temperature is also the lower the darker the shade of gray in this case.

Figure 4:
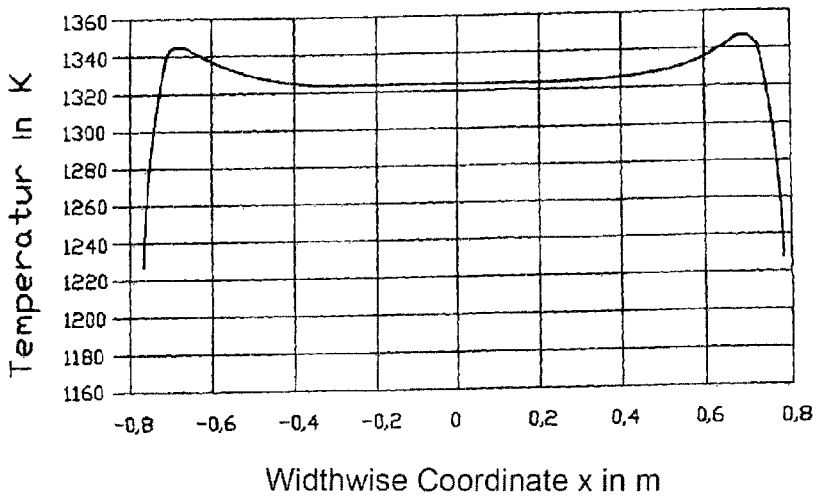
FIG. 4 Prior Art
FIG. 4, a progression of the average strip temperature referred to the width of the strip.

FIG. 4 shows a march of the average strip temperature as a function of the width of a preliminary strip, wherein this figure clearly shows that the temperature drops at the edge of the strip and that the temperature is also lower toward the interior. A zone situated adjacent to the edge has the highest average temperature.

Figure 5:
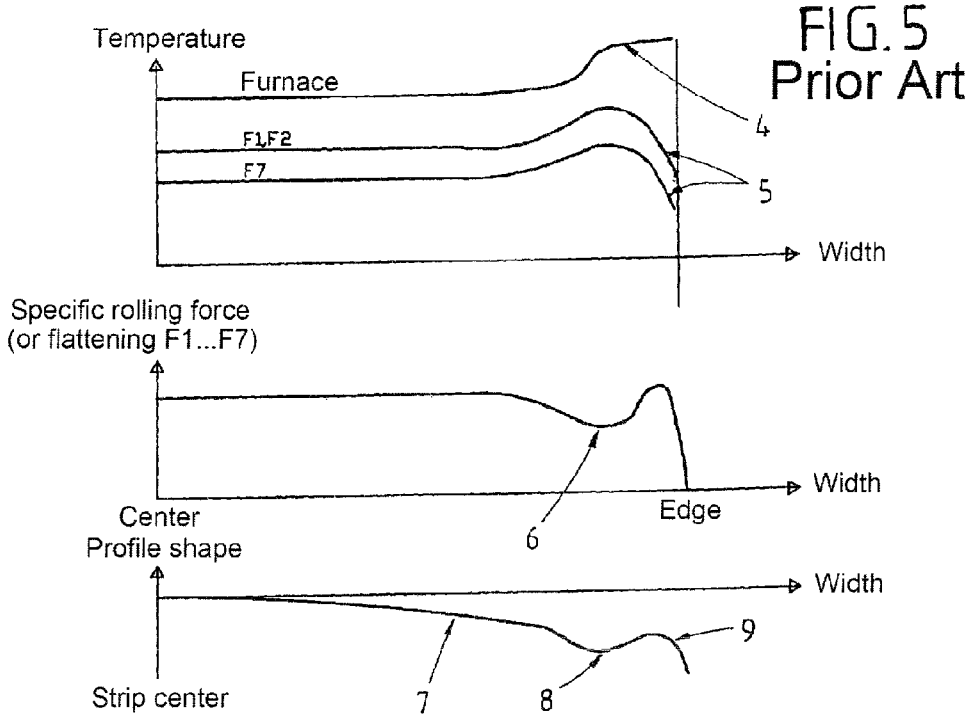
FIG. 5 Prior Art
FIG. 5, a march of temperature, the rolling force and the profile shape referred to the width of the strip.

FIG. 5 shows the progressions of the average temperature, a rolling force and the profile shape as a function of the width of the strip or the slab 1 in three diagrams that are arranged underneath one another. The upper partial figure shows the progression of the average temperature as a function of the width, wherein different temperature profiles 4.5 may result at different locations of the hot strip rolling mill (furnace, within the finishing train).

The reduced temperature on the edge results in a reduced rolling force 6 in the region of the temperature maximum near the edge because the location of the highest material temperature usually is also the softest.

Figure 7:
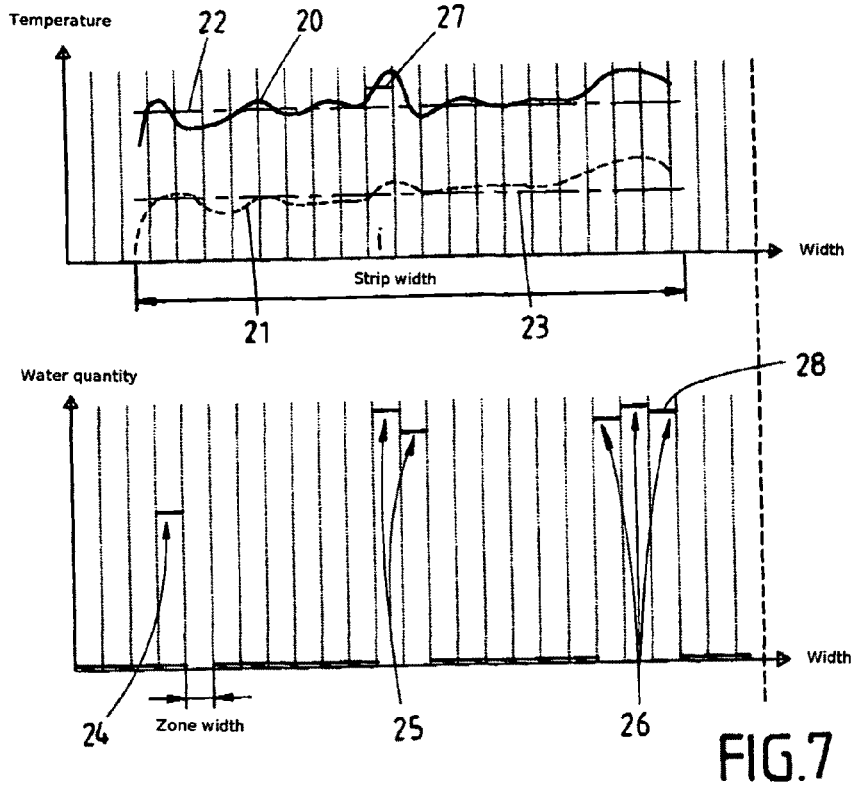
FIG. 7, a diagram for elucidating the march of temperature and the arrangement of cooling zones.

This results in a non-uniform profile shape (strip contour), wherein a profile anomaly 8 with reduced thickness and a shoulder with a bead 9 are created in the region of the highest temperature. The effect of the roll deflection and the effect of the correcting elements for realizing a thickness reduction from the outside toward the inside as shown in FIG. 7 are superimposed on this temperature effect. FIGS. 1 to 5 show the effect of non-uniform widthwise temperatures for one application example.

Figure 6:
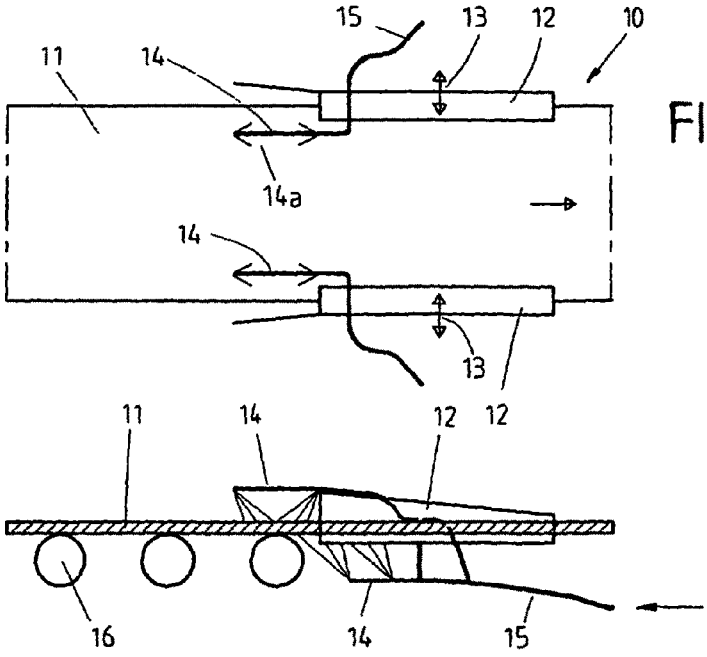
FIG. 6, representations of an inventive device.

The upper illustration of FIG. 6 shows a schematic representation of an inventive device 10 for cooling thin slabs, a preliminary strip or a strip 11. The strip 11 is laterally guided by adjustable lateral guides 12 or lateral guiding means provided for this purpose, respectively. The lateral guides 12 are realized such that they can be laterally adjusted along the direction of the arrow 13. In addition, cooling elements 14 such as cooling nozzles are provided for cooling the slab or the strip 11, wherein said cooling elements can be positioned at locations at which the highest temperature or high temperatures of the strip are measured or expected such that this region or these regions can be cooled separately. For example, it is possible to define a main cooling region 14*a* based on the temperature distribution and to additionally cool this main cooling region with the aid of a cooling medium such as, for example, cooling water. For example, the cooling water may be delivered to the nozzles 14 by means of hoses 15, wherein the hoses 15 are designed such that they are protected or can be shielded from the high ambient temperature. The device is illustrated in the form of a side view in the lower illustration. In this case, the strip is transported by means of rolls and the strip is at the same time partially cooled by means of a cooling medium such as cooling water or cooling air at the intended positions. It is advantageous if the cooling elements such as nozzles are arranged in the region of an adjustable lateral guide. Instead of using individual nozzles, it would also be possible to provide one or more groups of nozzles such that the cooling medium can also be applied on the strip such that it is distributed over a wide region.

This figure also shows that the nozzles 14 are arranged above and underneath the strip in such a way that the cooling process can take place from above and/or from below.

It is also particularly advantageous if the cooling medium quantity can be individually adjusted on the upper side and/or on the underside in dependence on a target variable (e.g., the temperature distribution, the target contour, the surface evenness) or on other process parameters such as the furnace residence time, the width, the width reduction, etc., so as to realize an optimized cooling of the corresponding strip regions.

An individual distribution of the nozzles can be realized if the widthwise temperature distributions of the strip are not always reproducibly identical.

The upper illustration of FIG. 7 shows a temperature distribution of a strip that is not distributed symmetrically. According to this figure, regions of elevated temperature and different widths are situated on or near the two edges, wherein a region of elevated temperature can also be found in the central strip region. In this case, the temperature profile downstream of the casting machine and/or downstream of the blooming stand and/or downstream of the furnace is illustrated in the upper curve 20 and the temperature profile downstream of the finishing train is illustrated in the lower curve 21. Furthermore, the dot-dash lines 22, 23 represent the nominal or target values of the temperature distribution. The line 27 represents an average value within the zone i.

The arrangement of the nozzles is chosen in accordance with the non-uniform distribution of the temperature maxima over the width of the strip. To this end, the lower illustration of FIG. 7 shows an arrangement of nozzles at the locations, at which the temperature is elevated relative to a nominal value. For example, a nozzle 24 is arranged in the region of the left strip edge, two nozzles 25 are arranged in the central region and three nozzles 26 are provided in the region of the right strip edge. Instead of the number of nozzles, it would also be possible to correspondingly distribute the quantity of the cooling medium 28 sprayed on the strip such that a comparable distribution of the cooling medium quantities is achieved. Consequently, the lower illustration of FIG. 7 shows a multi-zone cooling arrangement, in which the respective zones to be cooled can be individually adjusted.

Figure 7A:
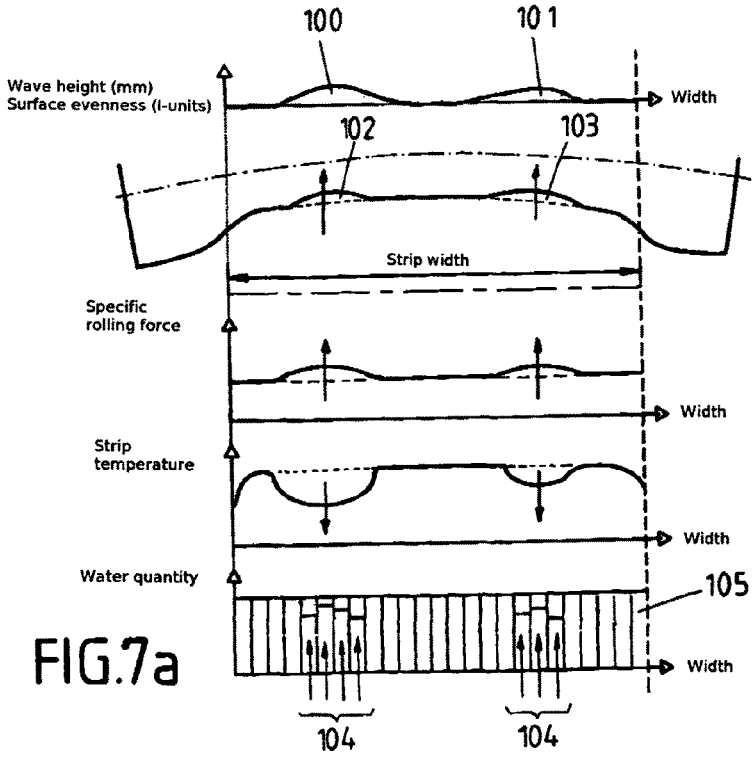
FIG. 7*a*, a diagram for elucidating the interaction between the surface evenness, the march of temperature and the activation of cooling nozzles.

The upper diagram of FIG. 7*a* shows a distribution of the wave height or surface unevenness of a strip as a function of the strip width for another application example. This diagram clearly shows two maxima 100, 101. The second diagram from the top shows the deformation of the roll body of a working roll that results from the cooling of the strip, wherein the contour in the region of the arrows 102, 103 indicates a change of the roll gap that can be recognized at the positions of the maxima in the upper illustration. The third diagram from the top shows the specific rolling force as a function of the width, wherein maxima as a function of the width can once again be recognized at the same location. The fourth diagram from the top shows a temperature distribution of the strip that is not uniformly distributed. This figure schematically shows an alternative example for elucidating the active principle of the invention, according to which a purposeful cooling of the strip is carried out as shown in the bottom diagram at locations at which a surface unevenness is detected so as to achieve an improved surface evenness downstream of the mill train. An improved surface evenness of the strip can be achieved by cooling the strip upstream and/or within the mill train in specifically selected regions over the width of the strip. The strip regions with uneven surfaces are usually cooled except for special instances. Due to the lower temperature, a higher yield strength and therefore an increased rolling force are adjusted at these locations as indicated in the center diagram in FIG. 7*a*. The change of the flattening in the roll gap of the delivery stand or, if applicable, on several stands of a mill train reduces or eliminates the surface unevenness. It is advantageous to observe the strip temperature tolerances when trimming the temperature of the strip. When rolling austenitic special steel, for example, the strip temperature can be adjusted or trimmed over broad ranges without negatively influencing the mechanical strip properties. The bottom diagram of FIG. 7*a* shows the arrangement of the cooling nozzles 104 and therefore a multi-zone cooling arrangement, in which the respective zones 105 to be cooled can be adjusted individually. An arrangement of individual nozzles, for example, in the quarter-wave region of the strip is also proposed or possible.

Figure 8:
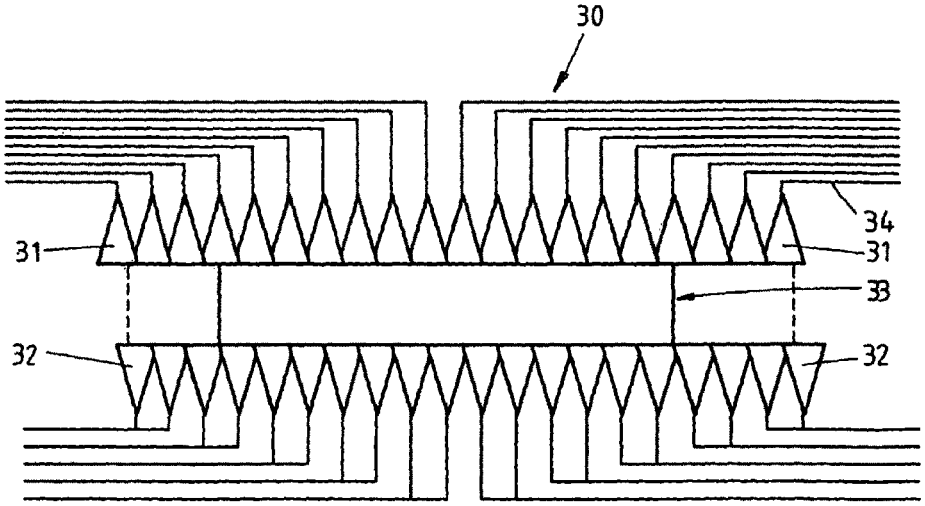
FIG. 8, a representation of an inventive device with cooling nozzles.

FIG. 8 shows a device 30 with an arrangement of nozzles 31, 32 for cooling a slab or a strip 33, wherein the nozzles 31, 32 are provided underneath the strip or the slab, as well as above the strip or the slab. Due to this measure, the nozzles are able to spray, if so required, a cooling medium on both sides of the strip or the slab such that the strip or the slab can be cooled at the relevant locations on both sides.

The nozzles 31, 32 are advantageously arranged in rows such that adjacent nozzles can also be arranged in an overlapping fashion. In this case, the respective nozzles also feature individual supply lines 34 for supplying a cooling medium such as, for example, water to the nozzles 31, 32 before it is applied to the strip by means of the nozzles. The nozzles 31, 32 may be advantageously arranged in a stationary fashion, wherein the nozzles 31, 32 may be connected by means of a holding frame or mount or the nozzles 31, 32 may be realized in a self-supporting fashion, in which case the nozzles 31, 32 may also be connected to one another.

However, the nozzles 31, 32 could also be advantageously positioned in such a way that they are held in an adjustable fashion with respect to their widthwise position.

For example, the nozzles 31, 32 may also be arranged in groups or pairs, for example, in a symmetrically paired fashion.

The nozzles may also have different nozzle cross sections or several nozzles may be connected in series in the material flow direction. For example, this makes it possible to realize a desired different distribution of the cooling medium quantities ("water crown"), in which larger nozzles than those in the central region are used in the edge region of the nozzle bar and even smaller nozzles are used in the center.

Figure 9:
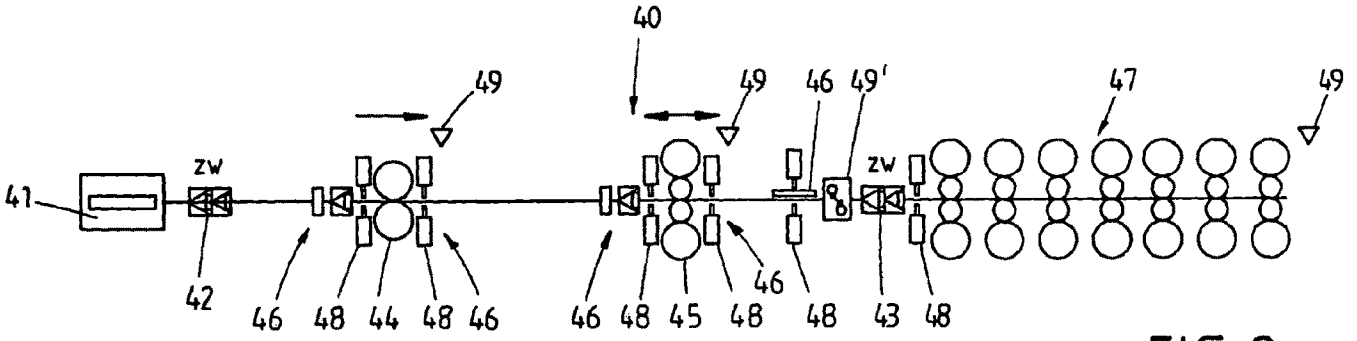
FIG. 9, a schematic representation of possible positions of a cooling device and temperature sensors within a hot strip rolling mill.

FIG. 9 schematically shows a device 40 for processing strips such as, for example, a broad strip hot rolling mill. The device 40 features a slab furnace 41 and two scale sprayers 42, 43. In addition, a first blooming stand 44 and a second blooming stand 45 are provided, wherein the first blooming stand 44 may be realized in the form of a pass-through stand and the second blooming stand 45 may be realized in the form of a reversing stand. Furthermore, lateral guides 46 are provided, for example, upstream or downstream of the blooming stands and upstream of the shears 49'. The rolling device 47, e.g., a finishing train, is provided at the end of the mill train before the strip is cooled and wound up on a not-shown coiler. According to the invention, devices 48 provided for influencing the temperature of the strip are equipped with nozzles. They are illustrated symmetrically in the form of a rectangle with a line that extends downward or upward. They may be arranged as shown upstream and/or downstream of the blooming stands 44, 45 and/or upstream and/or downstream of the shears 49'. In addition, temperature measuring devices 49 such as temperature scanners may be provided downstream of at least one of the blooming stands 44, 45 and/or downstream of the rolling device 47. The devices 48 for influencing the temperature of the strip may be arranged on the lateral guides upstream of the blooming stands, e.g., pass-through or reversing stands, and/or on the lateral guides upstream of the shears or upstream of the finishing train 47. In addition, devices 48 for influencing the temperature with the aid of nozzle arrangements can also be advantageously provided within the finishing stands of the finishing train 47. This may apply analogously to a plate rolling train, in which such devices 48 for influencing the temperature may be provided at the individual stages from the furnace to the plate rolling stand.

Figure 9A:
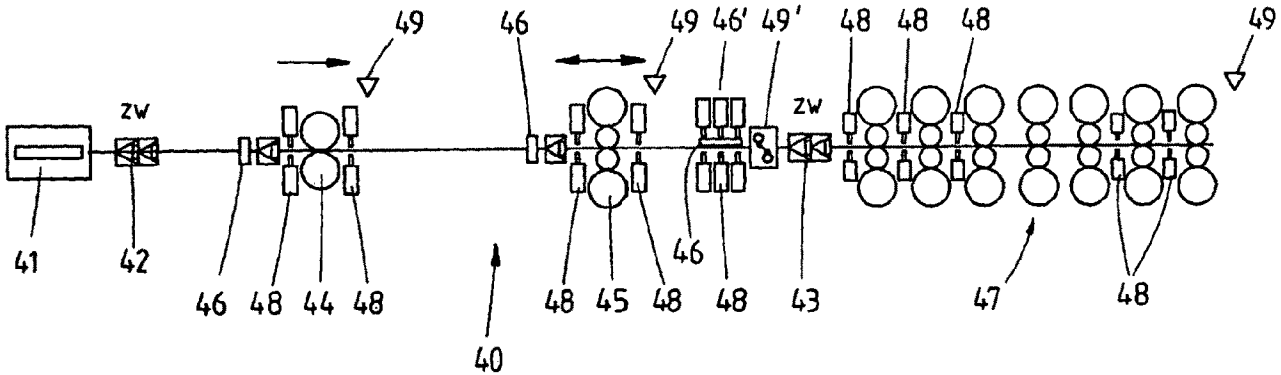
FIG. 9*a*, a schematic representation of possible positions of a cooling device and temperature sensors within a hot strip rolling mill.

FIG. 9*a* schematically shows another embodiment of a device 40 for processing strips such as, for example, a broad strip hot rolling mill. The device 40 features a slab furnace 41 and at least two scale sprayers 42, 43. In addition, a first blooming stand 44 and a second blooming stand 45 are provided, wherein the first blooming stand 44 may be realized in the form of a pass-through stand and the second blooming stand 45 may also be realized in the form of a reversing stand. Lateral guides 46 are also provided in this case, for example, upstream of the blooming stands 44 and upstream of the shears 49'. The rolling device 47, e.g., a finishing train, is provided at the end of the mill train before the strip is wound up on a not-shown coiler. According to the invention, devices 48 provided for influencing the temperature of the strip are equipped with nozzles. They may be arranged upstream and/or downstream of the blooming stands 44, 45 and/or upstream and/or downstream of the shears as shown. In addition, devices 48 for influencing the temperature of the strip may also be provided between individual stands in the region of the finishing train 47. The devices 48 for influencing the temperature are advantageously provided on the lateral guides arranged at these locations. Such devices may furthermore be provided in the region of a preliminary strip cooler 46' that may be arranged upstream of the finishing train. To this end, at least a portion of the cooling device preferably forms a strip zone cooling arrangement.

In addition, temperature measuring devices 49 such as temperature scanners may be provided downstream of at least one of the blooming stands 44, 45 and/or downstream of the rolling device 47. Devices 48 for influencing the temperature of the strip may be provided on the lateral guides upstream of the blooming stands, e.g., pass-through or reversing stands, and/or on the lateral guides upstream of the shears or upstream of the finishing train 47. Devices 48 for influencing the temperature with the aid of nozzle arrangements can also be advantageously provided within the finishing stands of the finishing train 47. This may apply analogously to a plate rolling train, in which such devices 48 for influencing the temperature may be provided at the individual stages from the furnace to the plate rolling stand.

Figure 10:
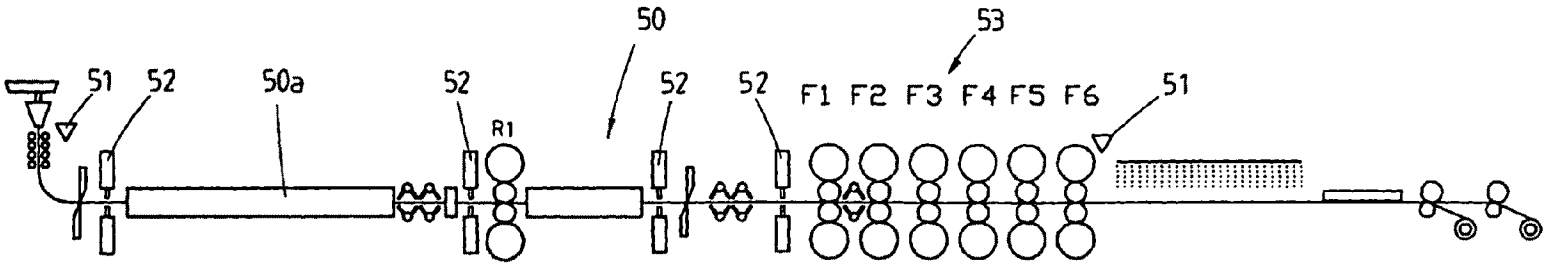
FIG. 10, a schematic representation of a CSP plant with possible positions of a cooling device and temperature measuring sensors.
Figure 10A:
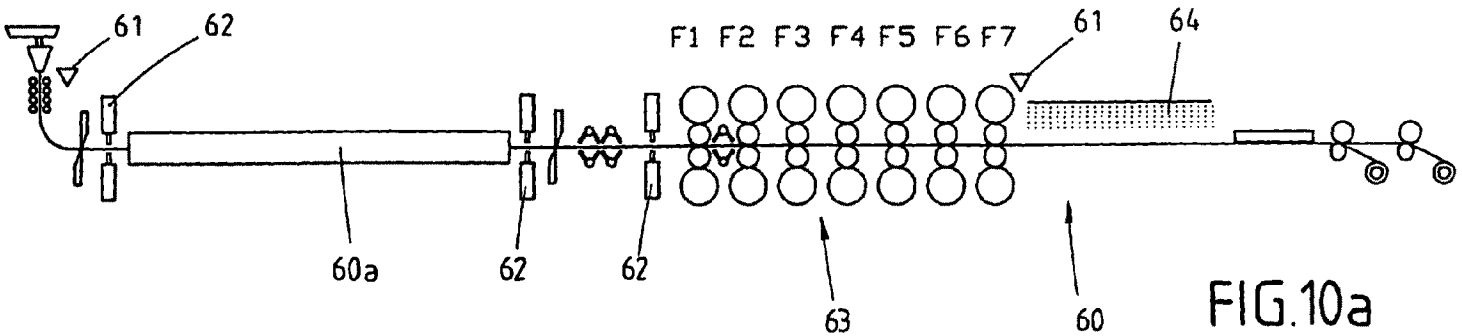
FIG. 10*a*, a schematic representation of a CSP plant with possible positions of a cooling device and temperature measuring sensors.
Figure 10B:
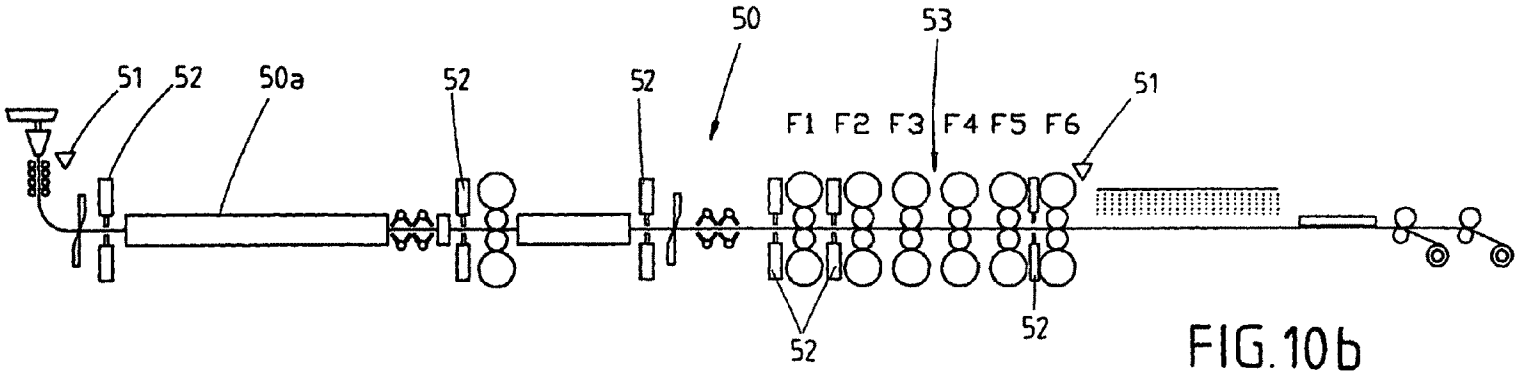
FIG. 10*b*, a schematic representation of a CSP plant with possible positions of a cooling device and temperature measuring sensors.
Figure 10C:
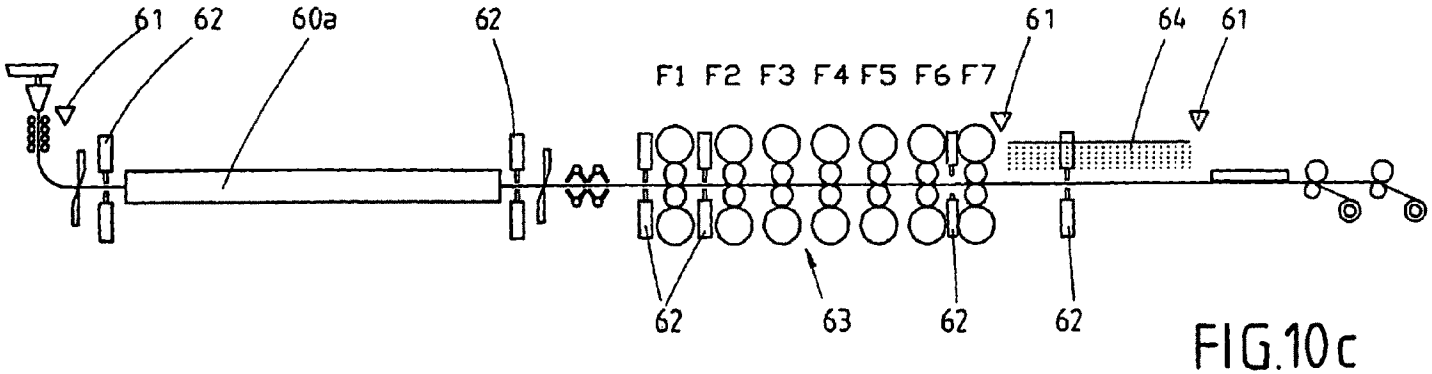
FIG. 10*c*, a schematic representation of a CSP plant with possible positions of a cooling device and temperature measuring sensors.

FIGS. 10 and 10*b* respectively show a so-called CSP (Compact Strip Production) plant 50 with a blooming stand and FIGS. 10*a* and 10*c* respectively show a CSP plant without a blooming stand.

The CSP plant 50 according to FIG. 10 features temperature measuring devices 51 that are arranged upstream of the roller hearth furnace 50*a* and downstream of the ingot mould, as well as one that is arranged on the end of the finishing train with the roll stands F1, F2, F3, F4, F5 and F6. The devices 52 for influencing the temperature with the aid of the nozzles for cooling the slab or the strip need to be advantageously arranged upstream and/or downstream of the roller hearth furnace, downstream of the ingot mould and/or upstream of the blooming stand R1 and/or downstream of the blooming stand R1 and/or upstream of the finishing train.

The plant according to FIG. 10*b* merely can be distinguished from the plants shown in FIGS. 10 and 10*a* in that additional cooling devices 52 are provided in the finishing train 53 between the roll stands F1 and F2, wherein additional cooling devices 52 could also be provided within the finishing train 53 between other roll stands F1, . . . , F6.

The CSP plant 60 according to FIG. 10*a* features temperature measuring devices 61, namely upstream of the roller hearth furnace 60*a*, downstream of the ingot mould and at the end of the finishing train with the roll stands F1, F2, F3, F4, F5, F6 and F7. The devices 62 for influencing the temperature by means of the nozzles for cooling the strip need to be advantageously arranged upstream and/or downstream of the roller hearth furnace, downstream of the ingot mould and/or upstream of the finishing train. The plant according to FIG. 10*c* merely can be distinguished from the plant shown in FIG. 10*a* in that additional cooling devices 62 are also provided in the finishing train 63 between the roll stands F1 and F2 and in the cooling section 64, wherein additional cooling devices 62 could also be provided within the finishing train 63 between other roll stands F1, . . . , F6. In addition, a temperature scanner 61 is provided at the end of the cooling section.

FIGS. 11, 11*a*, 11*b* and 11*c* respectively show a continuous thin slab plant 70, 80, in which the casting system and the rolling mill are directly coupled to one another. A particularly short plant is realized in this fashion. In plants of this type, the time for a temperature equalization from the solidification of the melt to the rolling process is very short. Consequently, the arrangement of inventive devices for cooling a strip is particularly preferred in such plants because a widthwise temperature equalization cannot be realized without cooling devices if the strip has a non-uniform temperature distribution. This is the reason why the cooling devices are provided, for example, in the form of a slab zone cooling arrangement or on the lateral guides in order to actively equalize the temperature widthwise in the different zones of the strip manufacture.

Figure 11:
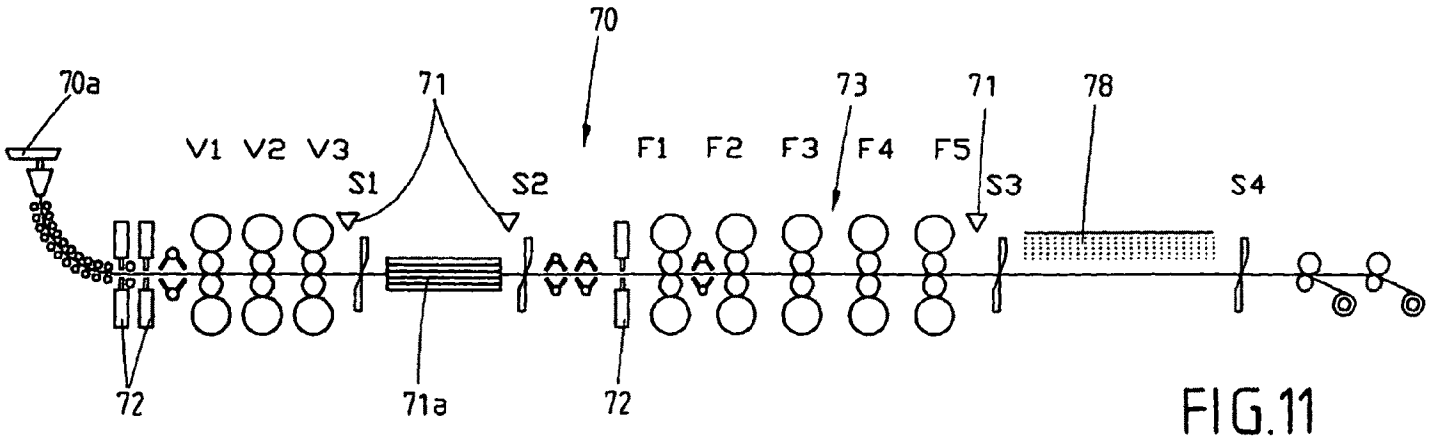
FIG. 11, a schematic representation of an alternative thin slab mill with possible positions of a cooling device and temperature measuring sensors.
Figure 11A:
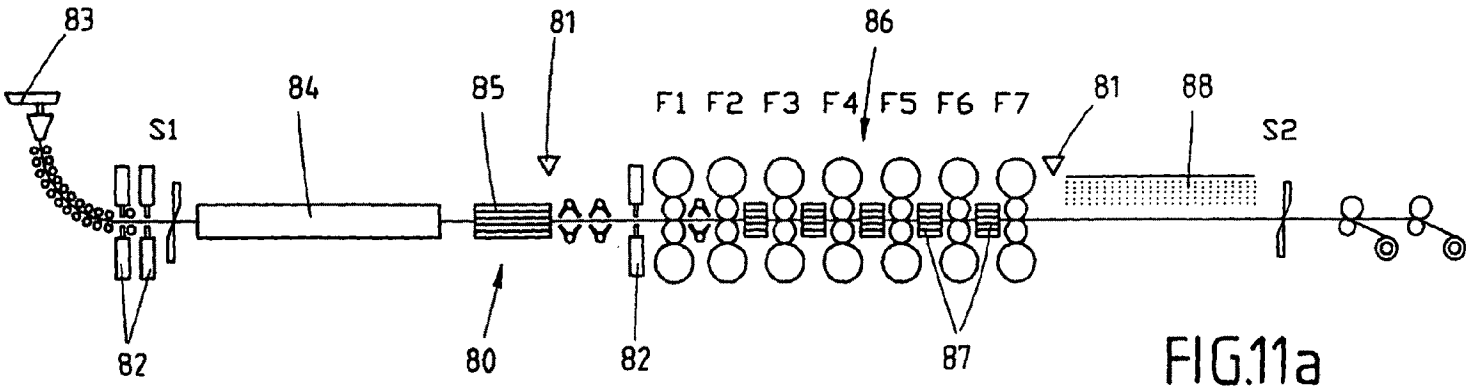
FIG. 11*a*, a schematic representation of an alternative thin slab mill with possible positions of a cooling device and temperature measuring sensors.
Figure 11B:
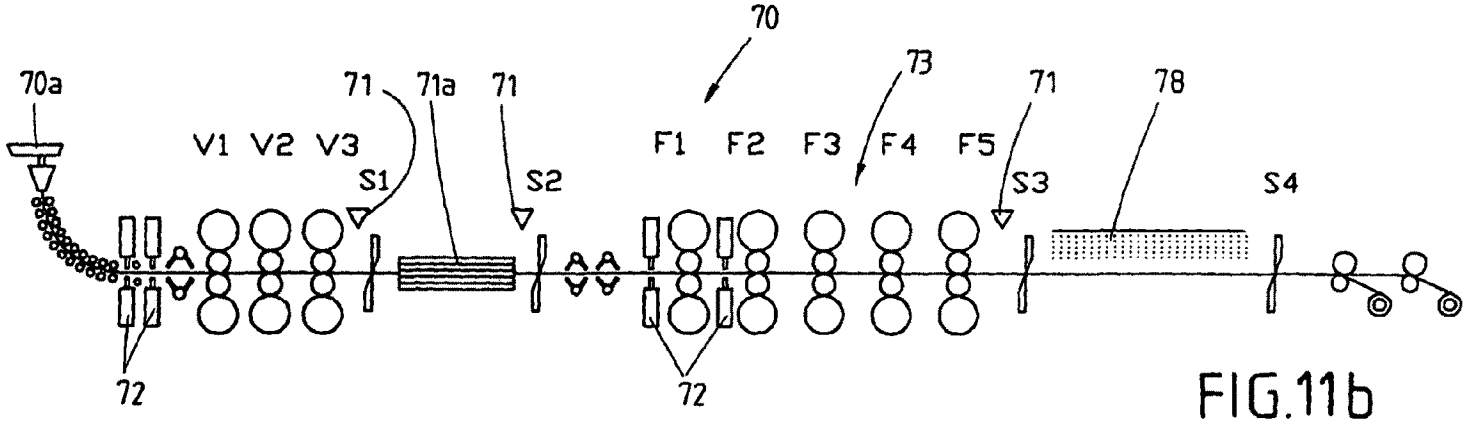
FIG. 11*b*, a schematic representation of an alternative thin slab mill with possible positions of a cooling device and temperature measuring sensors.

FIG. 11 and FIG. 11*b* respectively show temperature measuring devices 71 in the plant 70, wherein said temperature measuring devices are arranged downstream of the casting machine 70*a* and the blooming stands V1, V2, V3 and/or downstream of the heater 71*a*, e.g., a roller hearth furnace or an inductive heater, and/or downstream of the finishing train with the roll stands F1, F2, F3, F4 and F5. The devices 72 for influencing the temperature or for cooling by means of the nozzles for cooling the strip are advantageously arranged within and/or downstream of the casting machine, upstream and/or downstream of the heater, as well as upstream and/or within the finishing train 73 between roll stands F1, . . . , F5. In addition, a cooling section 78 for the strip is provided downstream of the finishing train.

Figure 11C:
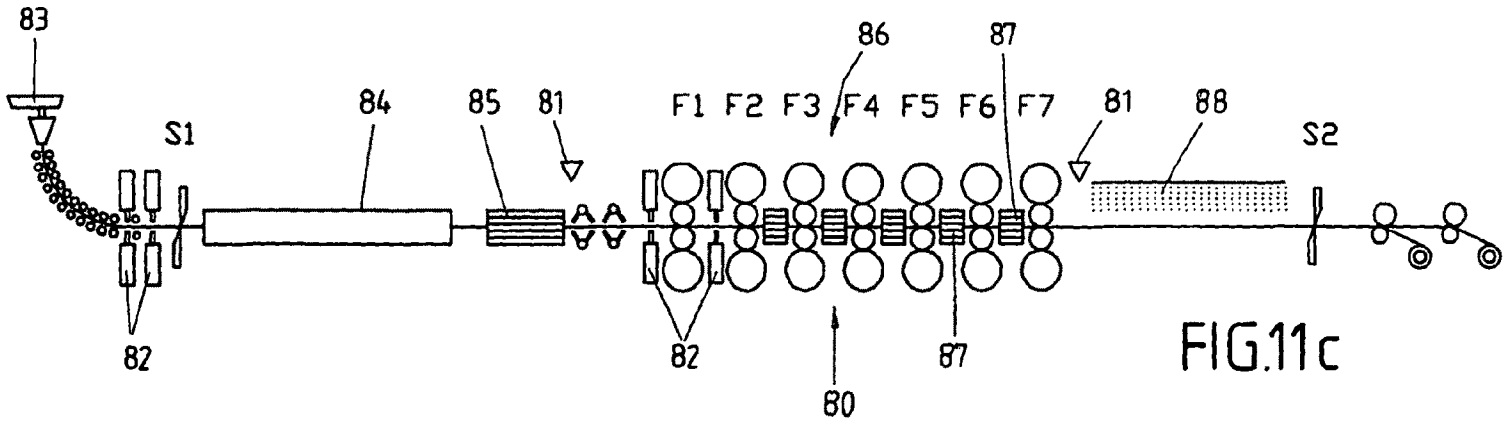
FIG. 11*c*, a schematic representation of an alternative thin slab mill with possible positions of a cooling device and temperature measuring sensors.

FIG. 11*a* and FIG. 11*c* show temperature measuring devices 81 in the plant 80, wherein said temperature measuring devices are arranged downstream of the casting machine 83 and the furnace or holding furnace 84 or downstream of the inductive heater 85, respectively, and/or downstream of the finishing train 86 with the roll stands F1, F2, F3, F4, F5, F6 and F7. The devices 82 for influencing the temperature or for cooling by means of the nozzles for cooling the slabs or the strip are advantageously arranged within and/or downstream of the casting machine 83, upstream and/or downstream of the heater 84 or 85, as well as upstream and/or within the finishing train 86 between roll stands F1, . . . , F7. In addition, an inductive or different heater 87 is provided in the finishing train 86, if so required, and a cooling section 88 for the strip is provided downstream of the finishing train.

Figure 12:
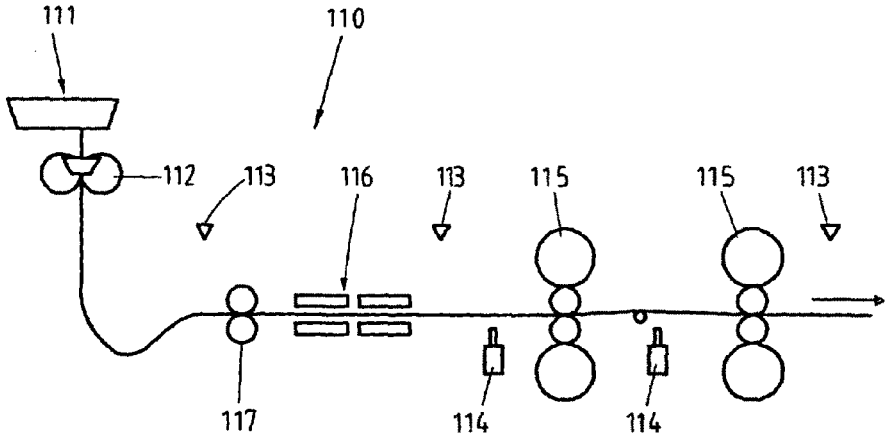
FIG. 12, a schematic representation of a continuous thin strip casting and rolling plant with possible positions of cooling devices and temperature measuring sensors.
Figure 12A:
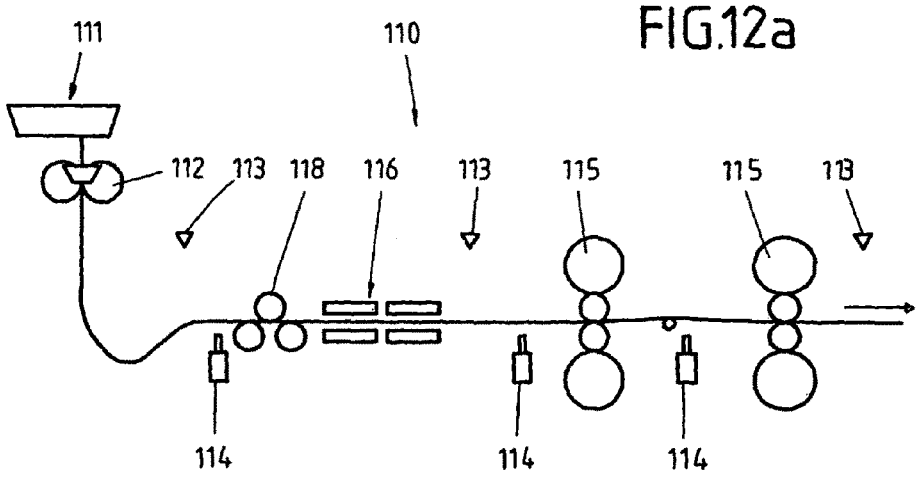
FIG. 12*a*, a schematic representation of a continuous thin strip casting and rolling plant with possible positions of cooling devices and temperature measuring sensors.

FIGS. 12 and 12*a* respectively show a continuous thin strip casting and rolling plant, in which the casting system 111 essentially consists of casting rolls 112. The temperature sensors or temperature scanners 113 for determining the temperature distribution of the strip are arranged along the strip guide. In addition, devices for realizing a strip zone cooling arrangement 114 are provided, wherein said devices may be arranged at the beginning of the plant and/or upstream and/or downstream of roll stands 115. The rolling mill may consist of one or more roll stands 115. In addition, a strip heater 116 is provided downstream of a leveler 118 or a driver 117. The strip contour can hardly be influenced any longer in such thin strip mills. The roll gap of the roll stands needs to adapt in accordance with the input profile. Accordingly, the correcting elements of the strip zone cooling arrangement that were mentioned several times or the special localized cooling at the inlet of the roll stands or upstream thereof or even between roll stands is advantageous with respect to improving the surface evenness of the strip. For example, it is possible to realize the cooling on both sides. However, the cooling process may also be carried out from one side only, e.g., from above or from below, on a thin strip that requires a specifically defined cooling effect.

One may also preceded in a comparable fashion in a plate rolling train, in which the temperature can be influenced similar to the above-described embodiments, namely after the slab exits the furnace and is transported to the plate rolling stand, as well as in the cooling section arranged downstream thereof. The temperature can also be influenced over the width of the strip in a hot strip rolling mill for nonferrous metals.

All embodiments have the purpose of homogenizing the strip temperature widthwise and of improving or purposefully influencing the contour and the surface evenness by suitably cooling the slab or the strip widthwise.

According to the invention, a fan nozzle, a center body nozzle, a complex air-water nozzle or a nozzle such as a tube or a tube arrangement of a laminar strip cooling arrangement can be used for cooling individual zones. In this case, different nozzles can be used for cooling different zones. It would also be possible to provide combined nozzle devices.

The nozzles or the widthwise cooling zones may also be spaced apart from one another by regular or irregular distances.

In order to realize the cooling process with the aforementioned purpose and the corresponding properties, it would be possible to utilize, for example, preliminary strip cooling, segment cooling in a continuous casting machine, intermediate stand cooling, descaling, roll gap cooling, cooling the upper side of the strip or the underside of the strip downstream of a looper, a cooling section or a combination of the above-described cooling devices. In this case, the roll gap cooling may essentially be carried out, for example, shortly or directly upstream of the roll gap by cooling the roll and/or the strip or the strip surface.

In addition, a cooling arrangement could also be provided in a cold rolling mill such that the surface evenness of the strip can at least be influenced indirectly by means of the cooling process.

Instead of arranging cooling nozzles on strip guides that are adjustable widthwise, the nozzles may also be arranged individually. It would also be possible to provide a multitude of nozzles over the width of the strip, wherein only the respective nozzles required for the cooling process are actuated and distribute the cooling medium. All in all, a multi-zone cooling process can be realized in this fashion.

Figure 13:
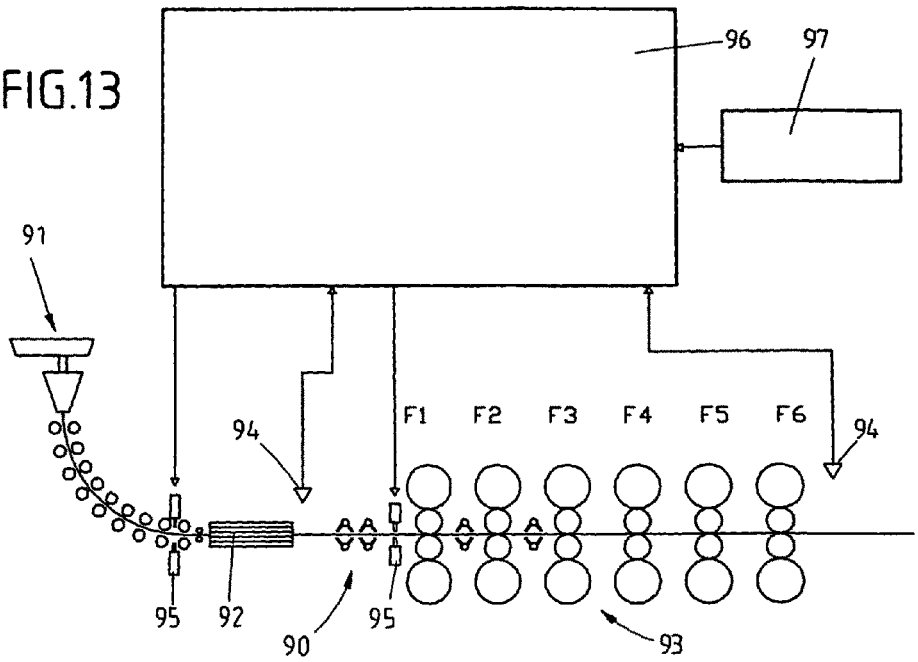
FIG. 13, a schematic representation of a thin slab mill with control unit in order to elucidate a method for cooling a strip and/or a thin slab, and FIG. 14, a schematic representation of a thin slab mill with control unit in order to elucidate a method for cooling a strip and/or a thin slab.

FIG. 13 schematically shows a thin slab mill 90 with a casting machine 91, a roller hearth furnace 92 or an induction heater, a finishing train 93 with rolling devices F1 to F6, as well as temperature sensors 94 and slab or strip cooling devices 95. The control unit 96 controls the strip cooling devices 95 based on the data of the temperature sensors 94, wherein the following input variables are still used for determining the cooling medium distribution and the cooling medium quantity and for actuating the respective nozzles of the cooling medium units: the casting thickness of the slab or the strip, the preliminary strip thickness, the width of the strip, the width reduction, the strip material, the furnace or the furnace type that can be identified, for example, based on the furnace number, the transport speed and the measured temperatures over the width of the strip. The effectiveness of the cooling process can also be evaluated downstream of the cooling process, e.g., downstream of the finishing train or at a different position, for example, based on the correlation between the heat transfer coefficient and the cooling medium quantity such as, for example, the water quantity; see Block 97.

Figure 14:
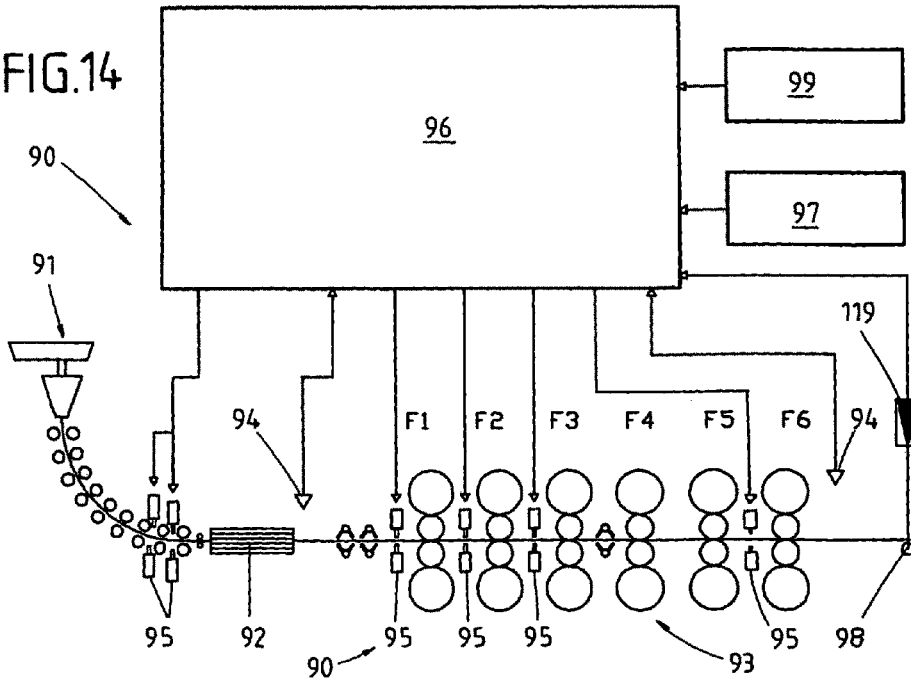

FIG. 14 schematically shows a thin slab mill 90 with a casting machine 91, a roller hearth furnace 92, a finishing train 93 with rolling devices F1 to F6, as well as temperature sensors 94 and strip cooling devices 95. The control unit 96 controls the strip cooling devices 95 based on the data of the temperature sensors 94 and/or the strip surface evenness sensor 98 and/or the strip profile measuring sensor 119, wherein the input variables listed in the last paragraph may also be used for determining the cooling medium distribution and the cooling medium quantity and for controlling the respective nozzles of the cooling medium units. The effectiveness of the cooling process can furthermore be evaluated downstream of the finishing train or at a different position, for example, based on the correlation between the heat transfer coefficient and the cooling medium quantity such as, for example, the water quantity; see Block 97. In addition, the surface unevenness and/or the strip contour, i.e., the correlation between the contour and/or surface evenness change and a required cooling medium quantity and a required cooling medium distribution, is determined and taken account in Block 99. In this case, the surface evenness of the strip and the deviation from the target surface evenness can be determined, for example, optically or based on a tensile stress distribution. In addition, the strip contour can be measured by the profile measuring sensor in order to thusly determine the deviation of the measured strip contour from the target contour.

In this case, it is not only possible to use a learning, adaptive preset model for defining the water quantity and its distribution, but it would also be conceivable to provide control circuits for regulating the adjusted target values or target functions by utilizing measured variables. For example, a temperature control circuit could be provided that would make it possible to utilize a strip temperature distribution measured, for example, downstream of a mill train and/or a cooling section for actuating the cooling zones with respect to their cooling medium quantity and cooling medium distribution so as to realize a largely homogenous temperature distribution of the strip.

In order to calculate the strip temperatures and the heat flows for determining the cooling medium quantity and distribution, it would furthermore be possible to utilize a method that takes into account the heat flows within the strips or slabs, respectively. This method also makes it possible to take the effectiveness of the cooling process into account.

The width of the strip is divided into cooling zones based on the data of the temperature sensors or temperature scanners—widthwise temperature distribution—and a temperature is assigned to the cooling zones. The cooling method evaluates the available data and determines which nozzles are activated and deactivated in dependence on the input variables and the information on the cooling effect, wherein it is also determined which cooling medium quantity needs to be adjusted at which nozzle in order to achieve an essentially homogenous temperature distribution.

In addition, a control circuit may be provided that makes it possible to also take into account the surface evenness of the strip, wherein this represents one alternative for ultimately obtaining a strip with a largely even surface by means of a suitable cooling medium distribution.

It would also be possible to provide a control circuit that takes into account the strip contour, wherein this represents another alternative for approximating the target strip contour (e.g., a parabola) more closely by means of a suitable cooling medium distribution.

LIST OF REFERENCE SYMBOLS

1 Slab
1*a* Edge
1*b* Core
2 Strip edge
3 Hot zone
4 Temperature profile
5 Temperature profile
6 Rolling force
7 Thickness reduction
8 Profile anomaly
9 Bead
10 Cooling device
11 Thin slab, preliminary strip or strip
12 Lateral guide
13 Direction
14 Cooling element, e.g., nozzle
14*a* Main cooling region
15 Hose
16 Roll
20 Curve
21 Curve
22 Line
23 Line
24 Nozzle
25 Nozzles
26 Nozzles
27 Average value of the temperature of a zone
28 Cooling medium quantity
30 Device
31 Nozzles, nozzle jet
32 Nozzles, nozzle get
33 Strip, slab or preliminary strip
34 Supply line
40 Device
41 Slab furnace
42 Scale sprayer
43 Scale sprayer
44 Blooming stand
45 Blooming stand
46 Lateral guide
46' Preliminary strip cooler
47 Rolling device, finishing train
48 Device for influencing the temperature
49 Temperature measuring device
49' Shears
50 CSP plant
50*a* Roller hearth furnace
51 Temperature measuring device
52 Device for influencing the temperature
53 Finishing train
60 CSP plant
60*a* Roller hearth furnace
61 Temperature measuring device
62 Device for influencing the temperature
63 Finishing train
64 Cooling section
70 Thin slab mill
70*a* Casting machine
71 Temperature measuring device
71*a* Heater
72 Device for influencing the temperature
73 Finishing train
78 Cooling section
80 Thin slab mill
81 Temperature measuring device
82 Device for influencing the temperature
83 Casting machine
84 Holding furnace
85 Heater
86 Finishing train
87 Heater
88 Cooling section
90 Thin slab mill
91 Casting machine
92 Roller hearth furnace
93 Finishing train
94 Temperature sensors
95 Strip cooling device
96 Control unit
97 Block for control
98 Strip surface evenness sensor
99 Block for control
100 Maximum wave height or strip surface evenness
101 Maximum wave height or strip surface evenness
102 Deformation in the region of the arrows
103 Deformation in the region of the arrows
104 Nozzles
105 Zones
111 Casting plant
112 Casting roll
113 Temperature sensor, temperature scanner
114 Strip zone cooling temperature
115 Roll stand
116 Strip heater
117 Driver
118 Leveler
119 Strip profile measuring sensor

The invention claimed is:

1. A device for influencing temperature distribution over a width of a slab or a strip (33), comprising: at least one cooling device in a rolling mill, said cooling device that has nozzles (14) for applying a cooling medium on the slab or on the strip (33), wherein the nozzles (14) are at least one of arranged and actuated widthwise so that the cooling medium is applied 1) at positions at which an elevated temperature is determined, or 2) in a controlled fashion in dependence on a measured strip contour so that the strip contour approximates a desired target contour more closely, at least one of the nozzles being positionally adjustable relative to the width of the slab or the strip, wherein the nozzles are mounted on two opposite a lateral guides that guide lateral sides of the slab or the strip, the guides are laterally adjusted along the direction of the width so as to provide widthwise adjustment of the nozzles, wherein shapes or types of the nozzles differ widthwise with respect to at least one of cooling medium quantity and spray pattern.

2. The device according to claim 1, wherein at least one measuring sensor (51) is provided for determining temperature distribution of the slab or the strip across the width of the slab or the strip so that the nozzles of the cooling device are activatable in dependence on a sensor signal.

3. The device according to claim 1, wherein at least one measuring sensor (98) is provided for determining surface unevenness of the strip across the width of the strip downstream of a mill train such that the nozzles to be activated are selected in dependence on a signal of the surface unevenness measuring sensor.

4. The device according to claim 1, wherein at least one measuring sensor (119) is provided for determining the strip contour across the width of the strip downstream of the mill train such that the nozzles to be activated are selected in dependence on a signal of the contour measuring sensor.

5. The device according to claim 1, wherein the width of the slab or the strip (33) is divided into cooling zones, wherein at least one nozzle (14) of the cooling device is respectively provided for at least one zone.

6. The device according to claim 1, wherein the nozzles (14) are arranged in pairs, and symmetrically relative to a center of the strip (33).

7. The device according to claim 6, wherein separate adjusting devices are provided for independent width adjustment of the nozzle position for at least one of a right half and a left half of the slab or strip.

8. The device according to claim 7, wherein the adjusting devices are respectively separate.

9. The device according to claim 1, wherein the nozzles (14) are arranged adjacent to one another, wherein at least one nozzle (14) is assigned to at least one cooling zone.

10. The device according to claim 9, wherein the nozzles or the cooling zones are spaced apart from one another widthwise by regular or irregular distances.

11. The device according to claim 1, wherein the nozzles (14) are arranged at least one of above and underneath the strip.

12. The device according to claim 1, wherein a control unit (96) is provided that processes relevant input variables and determines and controls the cooling medium quantity to be applied for the respective cooling zone or cooling position.

13. The device according to claim 12, wherein a closed loop control circuit is provided that activates the nozzles to be used for cooling in dependence on a measured temperature distribution of the strip or the slab.

14. The device according to claim 12, wherein a closed loop control circuit is provided that cools the strip prior to a last deformation in dependence on measured surface unevenness of the strip such that the surface evenness of the strip is improved after the last deformation.

15. The device according to claim 12, wherein a closed loop control circuit is provided that cools the strip prior to a last deformation in dependence on a measured strip contour so that the strip contour approximates a desired target contour more closely.

* * * * *